US006460233B2

(12) United States Patent
Noelle

(10) Patent No.: US 6,460,233 B2
(45) Date of Patent: Oct. 8, 2002

(54) PROCESS FOR THE PRODUCTION OF A COMPLEX NONWOVEN MATERIAL AND NOVEL TYPE OF MATERIAL THUS OBTAINED

(75) Inventor: Frédéric Noelle, Saint Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 09/756,842

(22) Filed: Jan. 9, 2001

(65) Prior Publication Data

US 2001/0005926 A1 Jul. 5, 2001

Related U.S. Application Data

(63) Continuation of application No. PCT/FR99/01425, filed on Jun. 15, 1999.

(51) Int. Cl.[7] ..... D04H 1/46

(52) U.S. Cl. ..... 28/104; 28/167

(58) Field of Search ..... 28/104, 105, 106, 28/167, 103, 165; 156/148, 62.2; 264/109, 121, 122; 442/408, 413, 384, 385, 387; 428/105, 109, 113

(56) References Cited

U.S. PATENT DOCUMENTS

| | | | | |
|---|---|---|---|---|
| 3,033,721 A | | 5/1962 | Kalwaites | |
| 3,214,819 A | | 11/1965 | Guerin | |
| 3,508,308 A | | 4/1970 | Bunting et al. | |
| 4,931,355 A | * | 6/1990 | Radwanski et al. | 28/104 |
| 5,320,900 A | | 6/1994 | Oathout | 428/288 |
| 5,375,306 A | | 12/1994 | Roussin-Moynier | 28/104 |
| 5,413,849 A | * | 5/1995 | Austin et al. | 28/104 |
| 5,718,022 A | | 2/1998 | Vuillaume | 28/122 |
| 5,768,756 A | | 6/1998 | Noelle | 28/104 |
| 6,007,653 A | * | 12/1999 | Pirinen et al. | 28/104 |
| 6,063,717 A | * | 5/2000 | Ishiyama et al. | 28/104 |
| 6,270,623 B1 | * | 8/2001 | Goda et al. | 28/104 |
| 6,314,627 B1 | * | 11/2001 | Ngai | 28/104 |

FOREIGN PATENT DOCUMENTS

| | | |
|---|---|---|
| EP | 423 619 A1 | 4/1991 |
| FR | 2741895 | 6/1997 |
| WO | WO 92/08834 | 5/1992 |

* cited by examiner

*Primary Examiner*—Amy B. Vanatta
(74) *Attorney, Agent, or Firm*—Heslin Rothenberg Farley & Mesiti P.C.; Mary Louise Gioeni, Esq.

(57) ABSTRACT

The invention concerns a method which consists in continuously: producing by carding (1) a web (10 from chemical fibers; subjecting the resulting web (1) to a hydro-entanglement using water jets, treatment which consists in: (a) consolidating the web (10) by the action of a first series of water jets (3), the web (10) being supported by a drum (4) comprising micro-perforations; (b) subjecting the consolidated web (10) to structuring, by the action of one or several series of water jets (12); depositing on the surface of the resulting structured lap (10*a*) natural fibers (14) by pneumatic layering (6); subjecting the resulting complex (20) to the action of another series of water jets (7) acting on the surface covered with natural fibers.

15 Claims, 3 Drawing Sheets

Eau
Eau

PROCESS FOR THE PRODUCTION OF A COMPLEX NONWOVEN MATERIAL AND NOVEL TYPE OF MATERIAL THUS OBTAINED

TECHNICAL FIELD

For decades, conventional textile webs (wovens, knits) have been replaced by so-called "nonwoven" structures which, in general, can be classified in three broad categories resulting from their actual manufacturing process, namely nonwovens produced by a so-called "dry route", by a so-called "melt route" and by a so-called "wet route".

The present invention relates to a novel type of material obtained according to the first technique mentioned, namely by a "dry route".

In general, to produce such nonwovens, a web of fibers of predetermined grammage is formed from discontinuous, natural or chemical, fibers by means of a card or other textile production machine, which web is then subjected to a treatment making it possible to give it the appropriate mechanical properties according to the uses to which the product is intended, for example a mechanical needle-punching treatment or a fluid-jet interlacing treatment.

Moreover, it has been known for a long time that the final properties of the product obtained can be modified by producing mixtures of materials, for example by combining together several webs consisting of fibers of a different nature, for example natural, artificial or synthetic fibers.

The aim of the invention is to provide a novel process making it possible to produce such a type of nonwoven article consisting of a mixture of fibers of different nature and which, in the rest of the description, will be denoted by the expression "hybrid nonwoven".

PRIOR ART

Up till now very many proposals have been made for producing hybrid nonwovens and more particularly nonwovens combining together a web of artificial or synthetic fibers and a web of cellulose fibers, especially wood fibers.

The various constituents are advantageously combined together by hydroentangling of fibers, a technique which has been known for a very long time and described, for instance, in patents U.S. Pat. Nos. 3,033,721, 3,214,819 and 3,508,308.

After having produced a first web, a layer of cellulose fibers, especially wood fibers, is deposited on it with a grammage approximately equivalent to that of the artificial or synthetic fibers, said cellulose fibers then being entangled with the chemical fibers, also using a treatment by means of water jets. The product obtained has good mechanical strength properties, these properties essentially being provided by the synthetic fibers, and good absorption properties, these being conferred by the cellulose fibers.

Such products are used especially for the manufacture of "wet wipes" denoted in this technical field by the expression "baby wipes", and in the hygiene field, and also known as cleaning cloths.

This type of hybrid nonwoven is increasingly tending to replace conventional nonwovens composed of a mixture of synthetic fibers (polyester or polypropylene) and artificial fibers (viscose), especially because of its lower manufacturing cost, the cost of wood fibers being three to four times less than viscose fibers.

In the current state of the art, as described above, a product is obtained whose strength and absorption properties are satisfactory but whose appearance and textile feel are unfortunately inferior to those of conventional nonwovens based on artificial and synthetic fibers.

This is due to the fact that the web is unsymmetrical in the thickness, the artificial and synthetic fibers being placed on one side of the web and the natural fibers on the other side.

In order to alleviate this drawback, tricks have been used such as spraying the natural fibers with softening chemicals, but this does not completely overcome the drawback.

Another negative aspect of this type of article is the abrasion resistance of the web, which is much lower on the natural-fiber side; this results during wiping operations in fiber loss (expulsion) which in many cases is regarded as unacceptable for the use of which it is made.

Consequently, in order to alleviate this drawback, it has been proposed to introduce natural fibers as a "sandwich" between two plies of artificial or synthetic fibers. This approach is not satisfactory from the technical standpoint or from the economic standpoint for the following reasons.

This is because the fact of dividing the grammage of the plies of artificial and/or synthetic fibers by two makes the hydroentangling of these plies very difficult. For example, in the case of a 50 g/m$^2$ product comprising 50% natural fibers (i.e. 25 g/m$^2$) and 50% synthetic fibers in two plies, i.e. 12.5 g/m$^2$ per ply, it is extremely difficult, if not impossible, to bond these plies together using water jets.

Moreover, the excessively low grammage of the first, support ply does not allow the latter to act as a filtering medium for the natural fibers during their deposition and then their interlacement with water jets. As a result, there is a considerable fiber loss, the fibers being expelled through the support fabric by the water jets, this fiber loss considerably reducing the economic advantage of the process.

SUMMARY OF THE INVENTION

The object of the present invention is to alleviate the problems and drawbacks mentioned above and to allow the production of an absorbent nonwoven containing a large amount of natural (wood pulp) fibers exhibiting excellent physical properties (tensile strength, tear strength and abrasion resistance) and good absorptivity, and also having an agreeable feel similar to that of products based on artificial and/or synthetic fibers.

In general, the invention therefore relates to a process allowing the production of a novel type of nonwoven consisting of a mixture of elementary fibers of different nature, which consists in continuously:

- producing, by carding or another conventional technique, a first web from chemical (artificial and/or synthetic) fibers;
- subjecting said web thus formed to a bonding treatment by means of water jets, said treatment consisting:
  - in a first step: in consolidating the web by the action of a first series of water jets acting on one of its faces, the web being supported by a drum having microperforations;
  - in a second step: in structuring the web thus consolidated by means of a roll or on a conveyor, the roll or conveyor being covered with a coarse fabric, by the action of one or more series of water jets;
- depositing, on the surface of the lap thus structured, natural fibers (wood fibers) by pneumatic layering;
- subjecting the complex thus formed to the action of a new series of water jets acting on the face covered with natural fibers;

carrying out a drying treatment and then collecting the end product in the form of a wound reel.

In order to implement the process according to the invention, the first water-jet treatment will be carried out according to the teachings of FR-A-2 730 246 and FR-A-2 734 285, the contents of which are incorporated in the present description as is required.

As regards the second water-jet treatment, which allows the lap of synthetic and/or artificial fibers to be structured, this is carried out using, as coarse fabric supporting the web, an apertured conveyor of the type described in FP-A-2 741 895, the content of which is also incorporated in the present application as is required.

In accordance with the process according to the invention, the cellulose fibers (wood fibers) may be distributed over the surface of the web of synthetic fibers both on that face which has been subjected to the action of the jets, allowing said lap to be structured, and on the opposite face.

Moreover, the structuring treatment may be carried out by making the second series of jets act both on the same face that has received the impact of the jets producing the consolidation action and on the opposite face to it.

The invention also relates to a novel type of nonwoven product obtained especially by implementing this process.

Such a hybrid nonwoven, which consists of a mixture of fibers of different nature, is characterized in that it is composed of a lap produced from chemical (artificial and/or synthetic) fibers which has received a treatment for bonding and reorienting the fibers by means of water jets, making it possible to have alternating regions of different porosity, natural, especially wood, fibers being preferably distributed within the regions of high porosity and the cohesion of the assembly also being obtained by entanglement due to the action of water jets.

BRIEF DESCRIPTION OF THE DRAWINGS

The invention and the advantages which stem therefrom will be more clearly understood thanks to the embodiments which follow, given by way of nonlimiting indication and illustrated by the appended drawings, in which.

MANNER OF REALIZING THE INVENTION

Referring to the appended drawings, and more particularly to FIGS. 1*a* and 1*c*, a nonwoven consisting of a mixture of elementary fibers of different nature is produced in the following manner.

Figures 1, 1A, 1B, 1C:
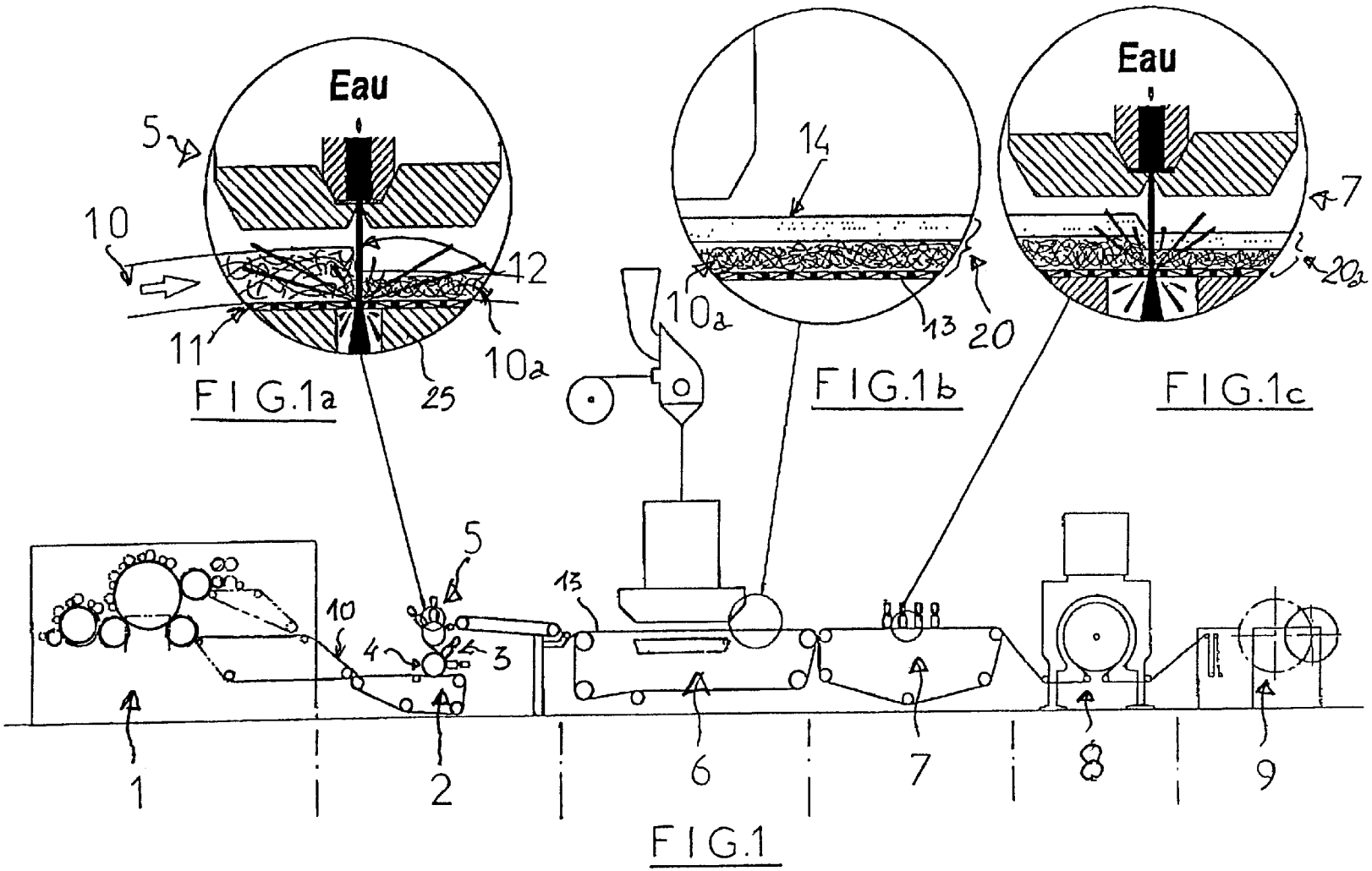
FIG. 1 is a schematic view of an overall production line for a complex material according to the invention, FIGS. 1*a*, 1*b*, 1*c* being enlarged views of the zones circled in this FIG. 1.

On a production line allowing the various operations to be carried out continuously, a first web (10) is produced from artificial or synthetic fibers by carding or another similar technique (zone labeled 1 in FIG. 1).

Next, this web (10) is taken to a treatment assembly (2) allowing it to be bonded by means of water jets.

This bonding treatment consists, in a first step, in consolidating the web by the action of a first series of water jets (3) acting on one of the faces of said web, the latter being supported by a drum (4) having microperforations.

Such a bonding system can be produced according to the teachings of FR-A-2 730 264 and FR-A-2 734 285.

After the web (10) has been consolidated, it is transferred to a treatment assembly (5) consisting either of a second perforated roll (25) or of an apertured conveyor allowing the lap formed to be structured.

To do this, the conveyor or the surface of the second roll consist of a coarse fabric of the type described in FR-A-2 741 895.

Figure 2:
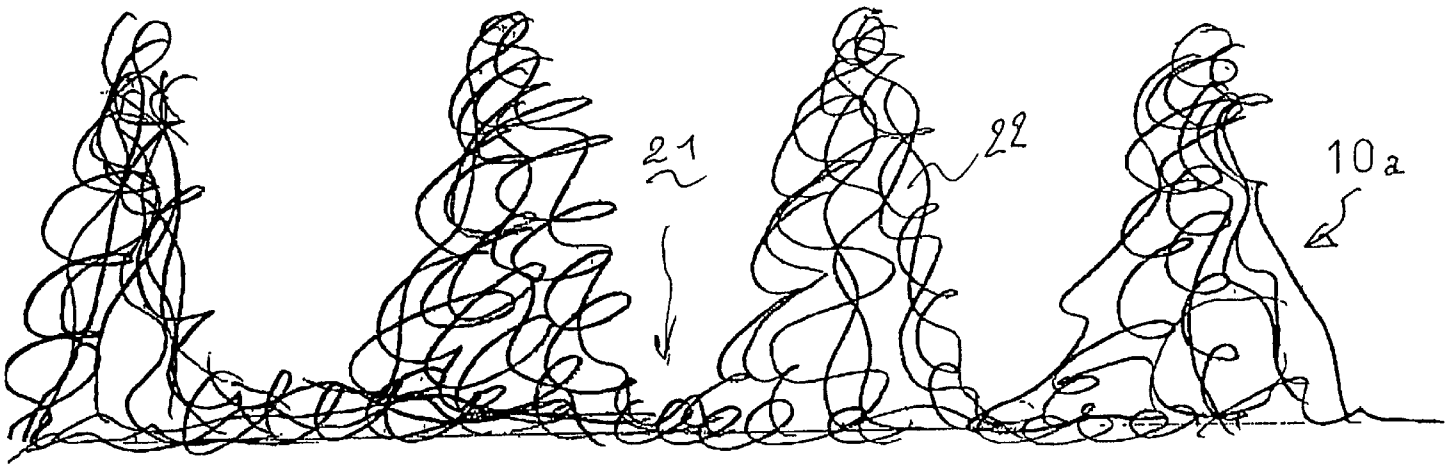
FIG. 2 is a schematic view, highly enlarged, showing the structure of the first lap based on chemical fibers after the treatment for consolidating and structuring the web.

At this point, as is apparent in FIG. 1*a*, the fibrous web (10) supported by the coarse fabric (11) is subjected to the action of water jets (12) whose action is such that the fibers of the web (10) are moved apart by said jets to the point of intersecting the strands of the fabric (11), thereby resulting in the formation of a web (10*a*) having a three-dimensional organization of the fibers with regions of varying density, where the structure of such a restructured web is illustrated in FIG. 2; it may therefore be stated that such a web has regions (22) of high fiber density separated from each other by regions (21) of low fiber density.

The structured web (10*a*) is then taken to an assembly (6) allowing fibers (14) of another nature, and more particularly cellulose (wood) fibers, to be distributed over its surface.

Figure 3:
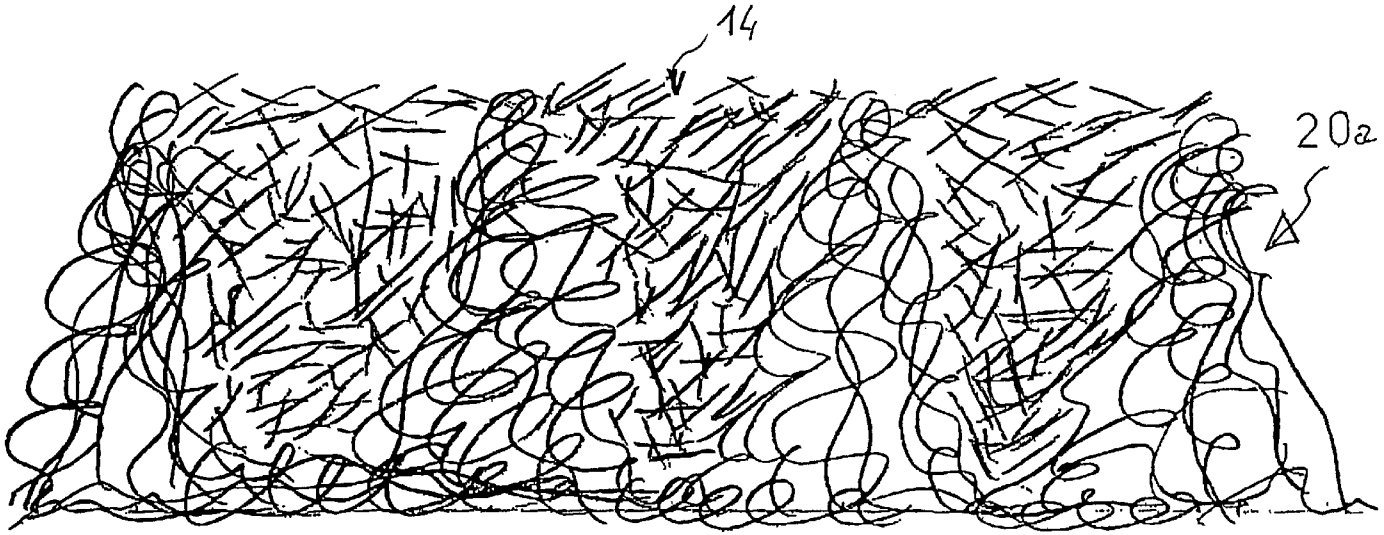
FIG. 3 is a schematic enlarged view of the hybrid complex produced according to the invention.

Such an assembly (6) makes it possible to deposit said fibers by the technique called "pneumatic layering", the web (10*a*) (see FIG. 2*a*) being held by a conveyor belt (13) subjected to a sucking action, the natural, more particularly wood, fibers (14) being thrown onto the surface of the web (10*a*) by means of a stream of air. Due to the suction action, said fibers therefore tend to be deposited in the regions having the highest porosity, that is to say in the region (21) in FIG. 2, making it possible to form a complex as illustrated in FIG. 3 in which the natural fibers—wood fibers—are deposited between the artificial and synthetic fibers.

The complex (20*a*) thus produced is then transferred to an assembly (7) used for carrying out an entangling treatment using water jets, as illustrated in FIG. 1*c*.

The hybrid nonwoven obtained is then dried at (8) before being conventionally wound up at (9).

Figure 4:
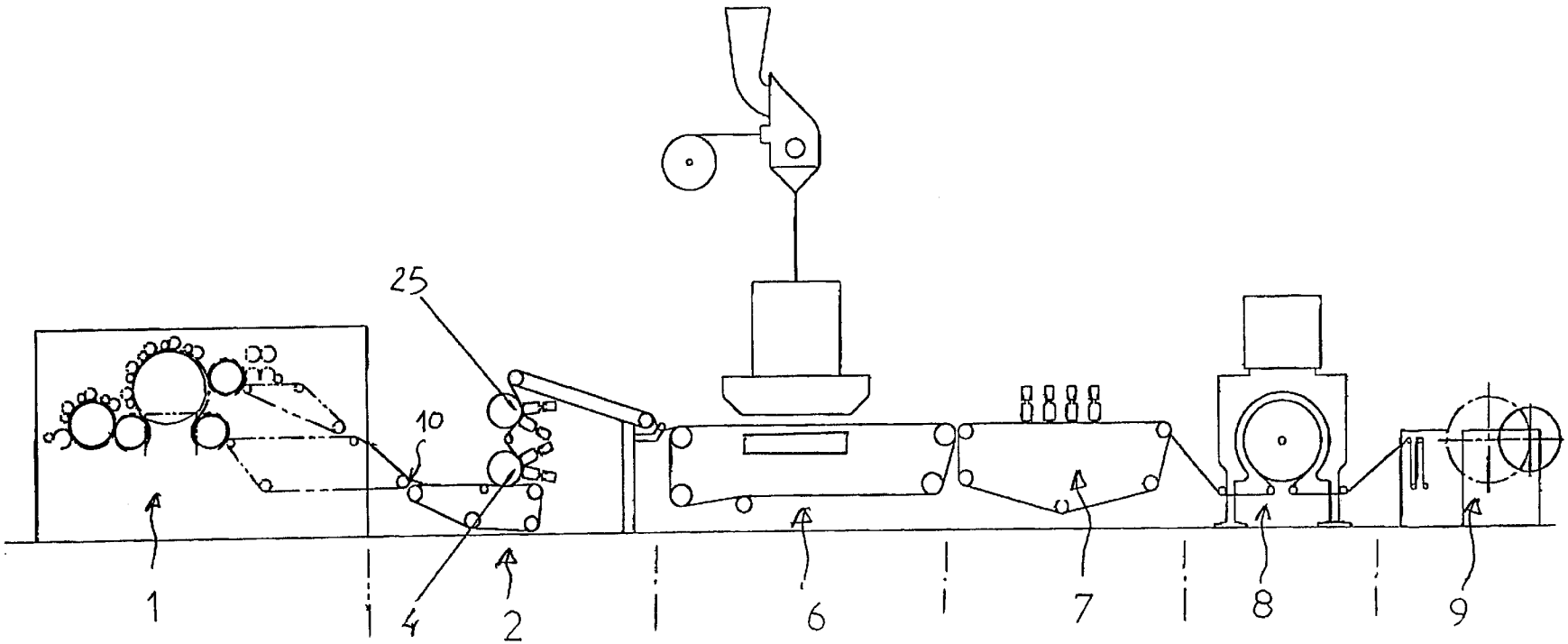
FIG. 4 is a schematic view of an alternative embodiment of a production line for a material according to the invention.

FIG. 4 illustrates an alternative embodiment of the invention, which differs from that illustrated in FIG. 1 by the way in which the operation of structuring the lap, after the first treatment by fluid jets at (4), is carried out.

In fact, in this case, the operation of structuring using jets is carried out by making the jets act on the same face as that which had already been treated.

By virtue of such a process, hybrid complexes are obtained in which there is excellent interpenetration of the various natural, artificial and synthetic components, making it possible to avoid the two-sided appearance of the prior techniques.

EXAMPLE

A product according to the invention is produced in the following manner.

A 30 g/m$^2$ web composed of 40% 1.7 dtex/38 mm viscose fibers and of 60% 1.7 dtex/38 mm polyester fibers is produced on a "random"—type card at a rate of 110 m/min.

This web is introduced into a "Jetlace 2000" hydroentangling unit by means of a conveyor belt.

The web is compacted between this conveyor belt and a first bonding roll coated with a microperforated jacket, the holes being arranged randomly as described in French patent 2 734 285. After compaction, the web is prewetted by means of a spray rail which is located behind the conveyor belt, just after the point of compaction, and placed at right angles to the generatrix of the roll.

The web thus compacted and wetted is then subjected to the action of two hydraulic injectors delivering water jets 120 microns in diameter with increasing velocities of 90 and 110 m/s, the water jets being spaced apart by 1.2 mm.

The web is then introduced to a conveyor provided with a fabric consisting of 8.7 polyester yarns/cm 0.50 mm in diameter in the warp direction and 9.4 stainless steel yarns/cm 0.38 mm in diameter in the weft direction.

Two hydraulic injectors are placed above this conveyor. They blast the web with water jets 120 microns in diameter with velocities of 100 m/s, the jets being spaced apart by 0.5 mm.

The web is then expressed by means of a suction box connected to a vacuum generator.

The product leaving this conveyor has a puckered appearance of the pyramidal type, with regions of different fiber density.

The web is then introduced to a pneumatic layering machine which deposits 30 g/m$^2$ of cellulose fibers.

After these fibers have been deposited, the web is introduced to another conveyor above which there are four hydraulic injectors delivering water jets 120 microns in diameter, spaced apart by 0.6 mm, with velocities of 114 m/s.

The web is then expressed by a suction box connected to a vacuum generator and then dried by a through-air drum dryer at a temperature of 120° C., and then wound up.

It is found that the product thus obtained has excellent homogeneity, greatly superior to that of a similar but "unstructured" product.

Moreover, the feel of the product is excellent, it is difficult in particular to identify the respective (synthetic side and cellulose side) faces and, finally, the abrasion resistance both in the dry state and in the wet state is considerably improved, which results in the absence of any expulsion of the natural fibers.

What is claimed is:

1. A process for the production of a nonwoven comprising a mixture of elementary fibers of different nature, said process comprising continuously:

producing a web (10) from chemical fibers;

subjecting the web (10) thus formed to a bonding treatment by means of water jets, said treatment comprising:

in a first step: consolidating the web (10) by the action of a series of water jets (3) acting on one of its faces, the web (10) being supported by a drum (4) having microperforations;

in a second step: structuring the web (10) thus consolidated by the action of one or more series of water jets (12), the web (10) being supported by a coarse fabric (13) covering a suction roll or a conveyor;

depositing, on a surface of a web **(10*a*) thus structured, natural fibers (14) by pneumatic layering (6) to form a complex (20)**;

subjecting the complex (20) thus formed to the action of a series of water jets (7) acting on a face covered with natural fibers;

carrying out a drying treatment (8) and then collecting the end product in the form of a wound reel.

2. The process as claimed in claim 1, wherein cellulose fibers (14) are distributed over a surface of the web **(10*a*) on that face which has been subjected to the action of one or more series of water jets (12), allowing said web (10*a*)** to be structured.

3. The process as claimed in claim 1, wherein cellulose fibers (14) are distributed over a surface of the web **(10*a*) of synthetic fibers on a face opposite to that which has been subjected to the action of one or more series soft water jets (12), allowing said web (10*a*)** to be structured.

4. The process as claimed in claim 1, wherein structuring the web (5) is carried out by making the one or more series of water jets (12) act on a face of the web (10) that has received an impact of the series of water jets (3) producing a consolidation action.

5. The process as claimed in claim 1, wherein structuring the web (5) is carried out by making the one or more series of water jets (12) act on a face of the web (10) opposite to that which has received an impact of the series of water jets (3) producing a consolidation action.

6. A nonwoven produced by the process of claim 1.

7. A nonwoven produced by the process of claim 6, wherein said natural fibers are wood fibers.

8. A nonwoven produced by the process of claim 2.

9. A nonwoven produced by the process of claim 3.

10. A nonwoven produced by the process of claim 4.

11. A nonwoven produced by the process of claim 5.

12. The process as claimed in claim 2, wherein structuring the web (5) is carried out by making the one or more series of water jets (12) act on a face of the web (10) that has received an impact of the series of water jets (3) producing a consolidation action.

13. The process as claimed in claim 3, wherein structuring the web (5) is carried out by making the one or more series of water jets (12) act on a face of the web (10) that has received an impact of the series of water jets (3) producing a consolidation action.

14. The process as claimed in claim 2, wherein structuring the web (5) is carried out by making the one or more series of water jets (12) act on a face of the web opposite to that which has received an impact of the series of water jets (3) producing a consolidation action.

15. The process as claimed in claim 3, wherein structuring the web (5) is carried out by making the one or more series of water jets (12) act on a face of the web opposite to that which has received an impact of the series of water jets (3) producing a consolidation action.

* * * * *